US011592170B2

(12) United States Patent
Hawkins

(10) Patent No.: US 11,592,170 B2
(45) Date of Patent: Feb. 28, 2023

(54) MODULARIZED COMPONENT LIGHTING DEVICE

(71) Applicant: Troy-CSL Lighting Inc., City of Industry, CA (US)

(72) Inventor: Jacob Hawkins, Sierra Madre, CA (US)

(73) Assignee: Troy-CSL Lighting Inc., City of Industry, CA (US)

( * ) Notice: Subject to any disclaimer, the term of this patent is extended or adjusted under 35 U.S.C. 154(b) by 0 days.

(21) Appl. No.: 17/321,246

(22) Filed: May 14, 2021

(65) Prior Publication Data

US 2022/0364716 A1 Nov. 17, 2022

(51) Int. Cl.

| | |
|---|---|
| ***F21V 29/75*** | (2015.01) |
| ***F21V 15/01*** | (2006.01) |
| ***F21V 29/508*** | (2015.01) |
| ***F21V 17/10*** | (2006.01) |
| ***F21V 23/00*** | (2015.01) |
| ***F21Y 115/10*** | (2016.01) |

(52) U.S. Cl.

CPC ..... *F21V 29/75* (2015.01); *F21V 15/01* (2013.01); *F21V 17/105* (2013.01); *F21V 23/006* (2013.01); *F21V 29/508* (2015.01); *F21Y 2115/10* (2016.08)

(58) Field of Classification Search

CPC ..... F21V 29/75; F21V 15/01; F21V 17/105; F21V 23/006; F21V 29/508; F21Y 2115/10

See application file for complete search history.

(56) References Cited

U.S. PATENT DOCUMENTS

| | | | | |
|---|---|---|---|---|
| 7,306,359 | B2 * | 12/2007 | Harwood | F21V 21/35 362/648 |
| 7,357,541 | B2 * | 4/2008 | Gamache | F21S 8/02 248/314 |
| 8,182,116 | B2 * | 5/2012 | Zhang | F21V 21/046 362/294 |
| 8,297,804 | B2 * | 10/2012 | Buse | F21V 21/14 362/372 |
| 9,222,662 | B2 * | 12/2015 | Chen | F21V 29/70 |
| 10,663,153 | B2 * | 5/2020 | Nikooyan | F21V 17/14 |
| 2012/0155077 | A1 * | 6/2012 | Kim | F21V 23/02 362/235 |
| 2016/0209004 | A1 * | 7/2016 | Zauritz | F21V 3/02 |
| 2020/0132278 | A1 * | 4/2020 | Portinga | F21V 15/01 |
| 2020/0300420 | A1 * | 9/2020 | Guo | F21V 23/009 |
| 2021/0003272 | A1 * | 1/2021 | Zhang | F21V 21/35 |

* cited by examiner

*Primary Examiner* — Tsion Tumebo
(74) *Attorney, Agent, or Firm* — Foley & Lardner LLP

(57) ABSTRACT

A lighting device assembly includes an outer housing having an inner volume and an inner surface at least partially surrounding the inner volume, a first open end and a second open end. At least one rail is provided on the inner surface of the outer housing. A first heat sink member is received within the first open end of the outer housing and secured to the at least one rail. A light source is attached to the first heat sink member. A cap attaches to the outer housing to cover the second open end. A second heat sink member holding one or more driver electronics modules connects to the light source. The second heat sink member is secured to the cap and is received within the second open end of the outer housing when the cap attaches to the outer housing.

22 Claims, 11 Drawing Sheets

100

100

100

100

100

MODULARIZED COMPONENT LIGHTING DEVICE

BACKGROUND

Modern lighting devices have electronic light sources for emitting light, such as one or more light emitting diode (LED) components. Typically, the brightness of an LED light source is at least partially related to the speed in which heat can be transferred away from the LED component. For example, it may be desirable to maintain the temperature of the LED under about 105° Celsius for improved or maximum light output and efficiency. However, certain lighting devices such as, but not limited to, room or area lighting devices, may be configured to be mounted in an enclosed environment, such as in a housing and/or in a recess of a ceiling, wall or other structure. In those or other contexts, the lighting device may be mounted in a thermally contained or poorly ventilated environment which can inhibit the ability to quickly transfer heat away from the LED. Accordingly, it can be desirable to provide lighting device configurations that allow for sufficient transfer of heat from the LED light source to maintain the temperature of the light source at or below a threshold temperature during operation and, particularly, during operation in a thermally contained or poorly ventilated environment.

Lighting device assemblies of various examples described herein can be configured to have good heat transfer characteristics (to transfer and dissipate heat away from the LED), while also allowing the lighting device assembly to be located within a housing and/or within a recess or opening in a ceiling, wall or other object. In other examples, the lighting device assembly may be surface mounted on a surface of a ceiling, wall or other object, or mounted on a pedestal or other support structure extending from a ceiling, wall, or other object. In yet other examples, the lighting device assembly may be mounted in other suitable locations or environments.

SUMMARY

An example of a lighting device assembly includes an outer housing having an inner volume, where at least one inner surface at least partially surrounding the inner volume. The lighting device assembly has a first open end and a second open end, and at least one rail on the at least one inner surface of the outer housing. The lighting device assembly has a first heat sink member configured to be received at least partially within the first open end of the outer housing and be secured to the at least one rail. The lighting device assembly has a light source attached to the first heat sink member. The lighting device assembly has a cap that attaches to the outer housing to cover the second open end of the outer housing. A second heat sink member holds one or more driver electronics modules that connect to the light source. The second heat sink member is secured to the cap and configured to be received at least partially within the second open end of the outer housing when the cap attaches to the outer housing.

In a further example, the first and second heat sink members are configured to dissipate heat into the inner volume of the outer housing when the first and second heat sink members are received at least partially within the outer housing. The outer housing is configured to dissipate heat from the inner volume to an environment external to the outer housing.

In a further example, each of the first and second heat sink members are made of a thermally conductive material and have one or more heat radiation fins for dissipating heat from the first and second heat sink members into the inner volume of the outer housing when the first and second heat sink members are received at least partially within the outer housing. The outer housing is made of a thermally conductive material that is configured to dissipate heat from the inner volume.

In a further example, the outer housing comprises a tubular structure. The at least one rail comprises two or more rails on the at least one inner surface.

In a further example, the light source is attached to the first heat sink member in a position to emit light from the first open end of the outer housing when the first heat sink member is received at least partially within the first open end of the outer housing.

In a further example, the lighting device assembly includes a trim member configured to selectively connect to and disconnect from the lighting device assembly, at a location adjacent the first open end of the outer housing. The trim member is magnetically connected to the first heat sink member. The trim member includes one or more risers securing the one or more magnets to the trim member.

In a further example, each rail has a first end to which the first heat sink member connects when the first heat sink member is received at least partially within the first open end of the outer housing. Each rail has a second end to which the cap connects, to attach the cap over the second open end of the outer housing.

In a further example, the cap has one or more protrusions. Each protrusion has a channel for receiving a fastener for fastening the cap to the outer housing. The one or more protrusions include one or more spikes on a surface facing the at least one rail. The one or more spikes at least partially embedding into the at least one rail when the cap is fastened to the outer housing, to provide or enhance an electrical ground coupling of the cap with the outer housing.

In a further example, the cap has one or more protrusions having one or more spikes on a surface facing the second heat sink member. The one or more spikes at least partially embedding into the second heat sink member, to provide or enhance an electrical ground coupling of the cap with the second heat sink member.

In a further example, the lighting device assembly includes at least one ground wire connected to the second heat sink member and configured for connection to an external ground. The second heat sink member is in electrical communication with the cap. The cap is in electrical communication with the outer housing when the cap is attached to the outer housing, to connect the external ground to the cap and to the outer housing.

In a further example, the first heat sink member has an exterior surface with one or more grooves. A fluid seal is received in the one or more grooves for providing a watertight seal between the first heat sink member and the outer housing when the first heat sink member is at least partially received within the first open end of the outer housing.

In a further example, the at least one light source comprises at least one LED.

In a further example, the lighting device assembly includes a shaft to which the outer housing is connected. The shaft is configured to be secured to a ceiling or other structure, to suspend the outer housing from the ceiling or other structure.

An example of a method of making a lighting device assembly includes providing an outer housing having an inner volume, at least one inner surface at least partially surrounding the inner volume, a first open end and a second open end. The method of making the lighting device assembly includes providing at least one rail on the at least one inner surface of the outer housing, attaching a light source to a first heat sink member and receiving the first heat sink member with the light source at least partially within the first open end of the outer housing. The method of making the lighting device assembly includes securing the first heat sink member to the at least one rail and holding, in a second heat sink member, one or more driver electronics modules that connect to the light source. The method of making the lighting device assembly includes securing the second heat sink member to the cap and attaching the cap with the second heat sink member to the outer housing, to cover the second open end of the outer housing. The method of making the lighting device assembly includes receiving the second heat sink member at least partially within the second open end of the outer housing when attaching the cap to the outer housing.

In a further example, the first and second heat sink members are configured to dissipate heat into the inner volume of the outer housing when the first and second heat sink members are received at least partially within the outer housing. The outer housing is configured to dissipate heat from the inner volume to an environment external to the outer housing.

In a further example, the method of making the lighting device assembly includes providing the cap having one or more protrusions, each protrusion having a channel for receiving a fastener for fastening the cap to the outer housing. The method of making the lighting device assembly includes providing the one or more protrusions with one or more spikes on a surface facing the at least one rail and at least partially embedding the one or more protrusions into the at least one rail when the cap is fastened to the outer housing, to provide or enhance an electrical ground coupling of the cap with the outer housing.

In a further example, the method of making the lighting device assembly includes connecting a selectively connectable trim member to the lighting device assembly adjacent the first open end of the outer housing. The selectively connectable trim member is configured to selectively disconnect from the lighting device assembly.

BRIEF DESCRIPTION OF THE DRAWINGS

The above and other aspects and features of the present invention will become more apparent to those skilled in the art from the following detailed description of the example embodiments with reference to the accompanying drawings, in which.

DETAILED DESCRIPTION

Figure 1:
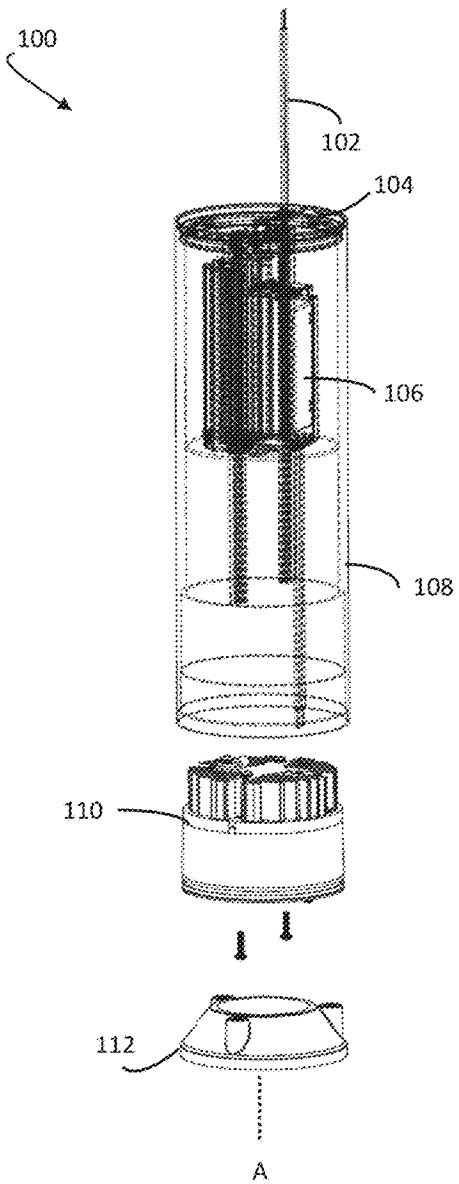
FIG. 1 is a partially transparent, perspective view of an example lighting device.

Hereinafter, example embodiments will be described in more detail with reference to the accompanying drawings. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated. Further, features or aspects within each example embodiment should typically be considered as available for other similar features or aspects in other example embodiments.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," "coupled to," "secured to" or "attached to" another element or feature, it can be directly on, connected to, coupled to, secured to or attached to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

According to various examples described herein, a modularized lighting device assembly is configured as a pendent lighting device for hanging from a ceiling or other structure. In other examples, the lighting device assembly may be configured to be in a recess or opening provided in a ceiling, wall, outer housing or other object. In some examples, the lighting device assembly is configured to be installed in an opening to a plenum, duct or attic space of a ceiling, or in an inner wall space in a manner to appear flush or substantially flush with an exposed surface of a ceiling, wall or other object. In other examples, variations of the lighting device assembly may be configured to be installed in a manner that is not flush with an exposed surface (and, instead, is configured to be recessed or protruding from the exposed surface of a ceiling, wall, outer housing or other object), or is configured to be surface-mounted on the exposed surface of the ceiling, wall, outer housing or other object. In yet other examples, variations of the lighting device assembly may be configured to be mounted on a support structure (such as, but not limited to a sconce structure, pedestal, shaft or the like).

The lighting device assembly includes a light source and an optic member that are configured to emit light in a cone or other pattern having a general axis or light emission direction. In examples in which the optic member includes one or more lenses, the axis of the light emission may correspond to an optical axis of the one or more lenses. In other examples, the axis of the light emission may correspond to a center of the light cone or pattern emitted by the light source and optic member.

Particular examples are configured to provide sufficient thermal communication and heat dissipation characteristics to help maintain the temperature of the light source at or below a desired threshold temperature for improved operation. In addition to thermal communication, the modularized lighting device assembly may be configured for ease of manufacture, assembly or servicing. In some examples, the modular components are configured to be electrically grounded in a simplified manner that minimizes grounding wires within the lighting device.

Figure 2:
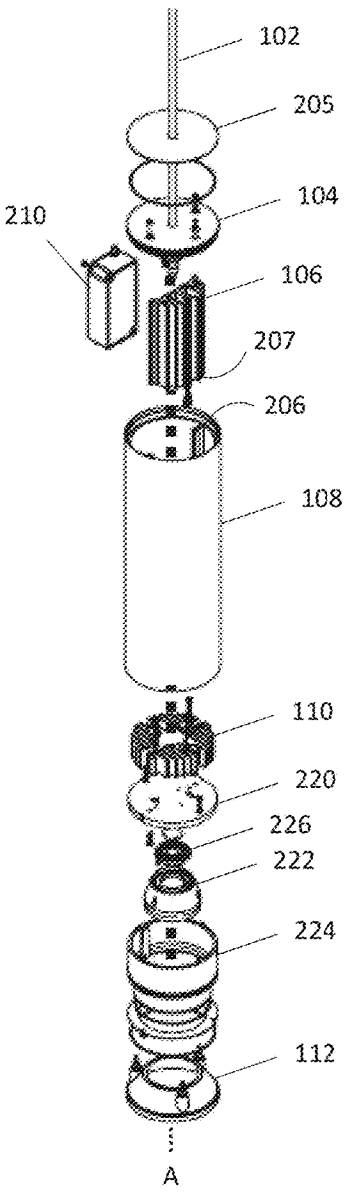
FIG. 2 is an exploded view of the example lighting device of FIG. 1.
Figure 3:
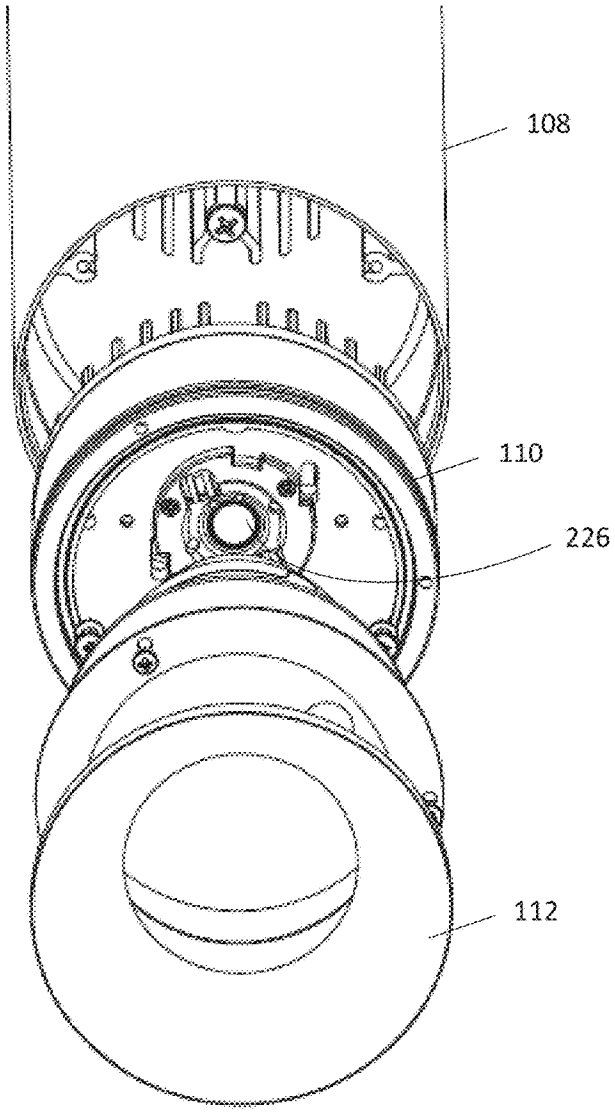
FIG. 3 is a perspective, partially exploded bottom view of a portion of the example lighting device of FIG. 1.
Figure 4:
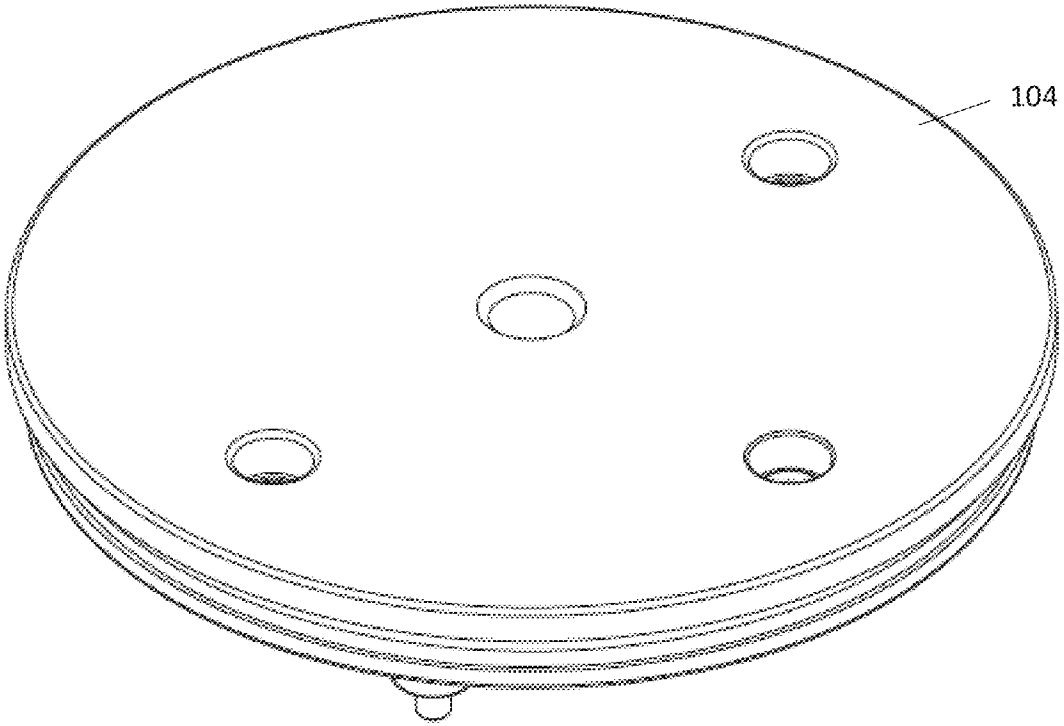
FIG. 4 is a top view of a cap of the example lighting device of FIG. 1.
Figure 5:
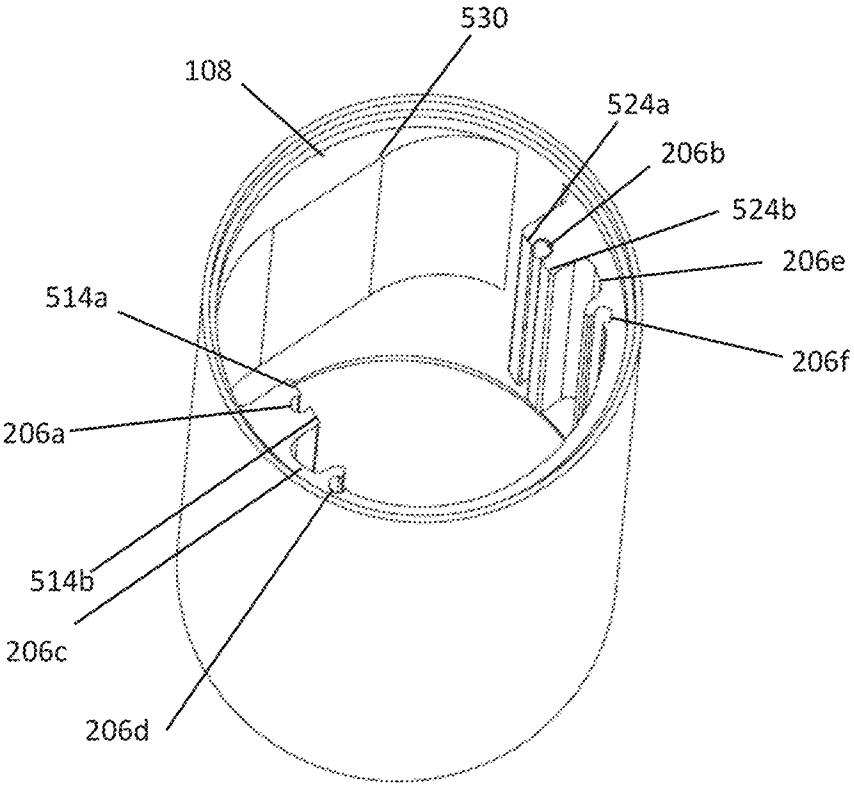
FIG. 5 is a perspective view of a portion of the outer housing of the example lighting device of FIG. 1.
Figure 6:
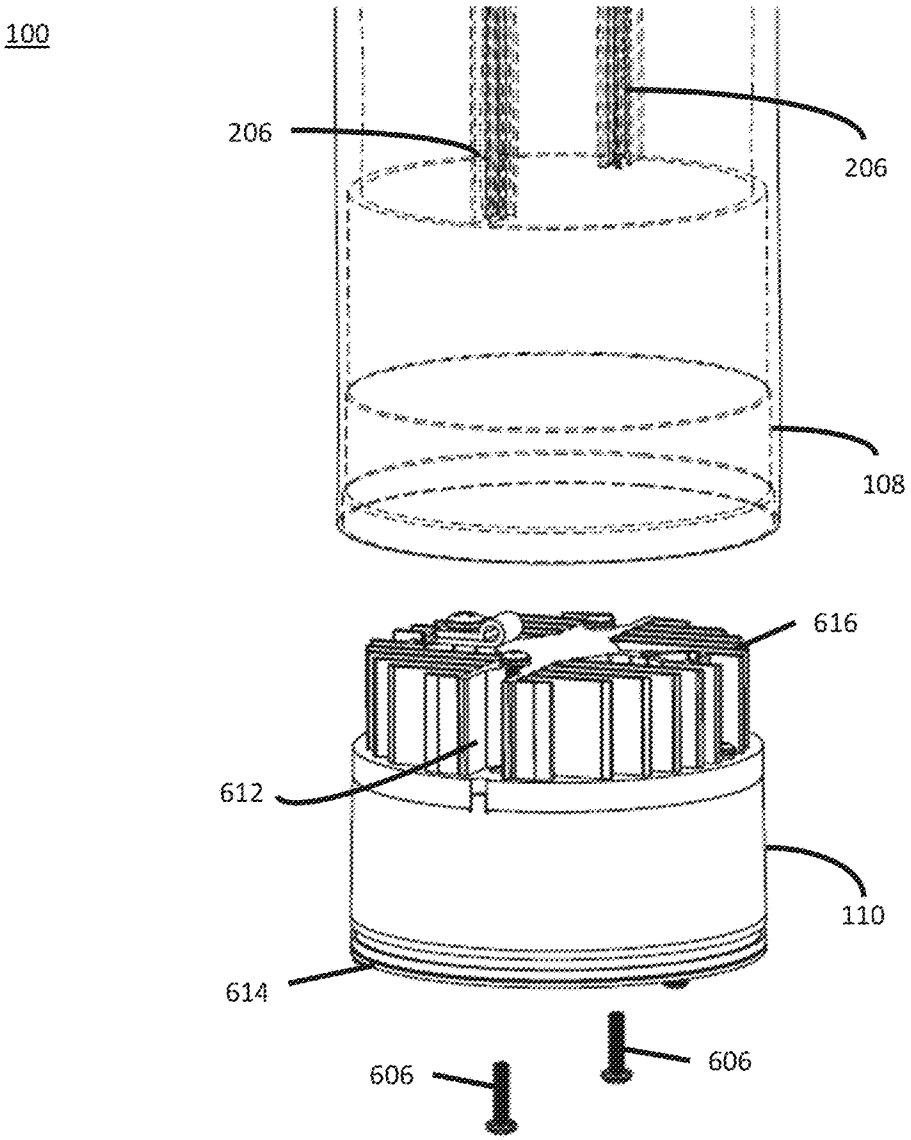
FIG. 6 is a perspective, partially exploded view of a portion of the outer housing and a light engine heat sink of the example lighting device of FIG. 1.
Figure 7:
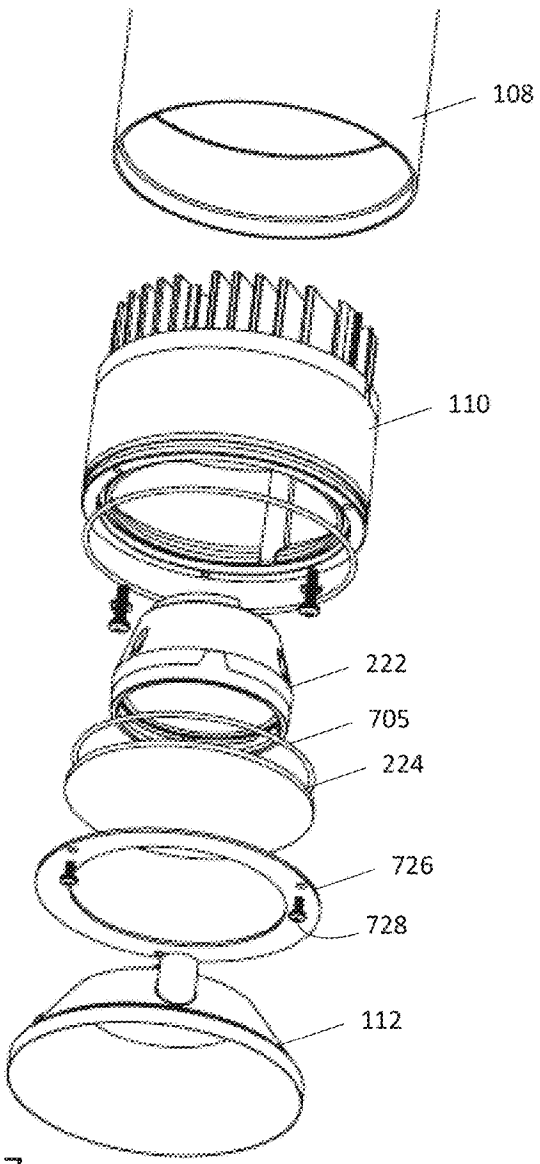
FIG. 7 is a perspective, partially exploded view of a portion of the example lighting device of FIG. 1.
Figure 8:
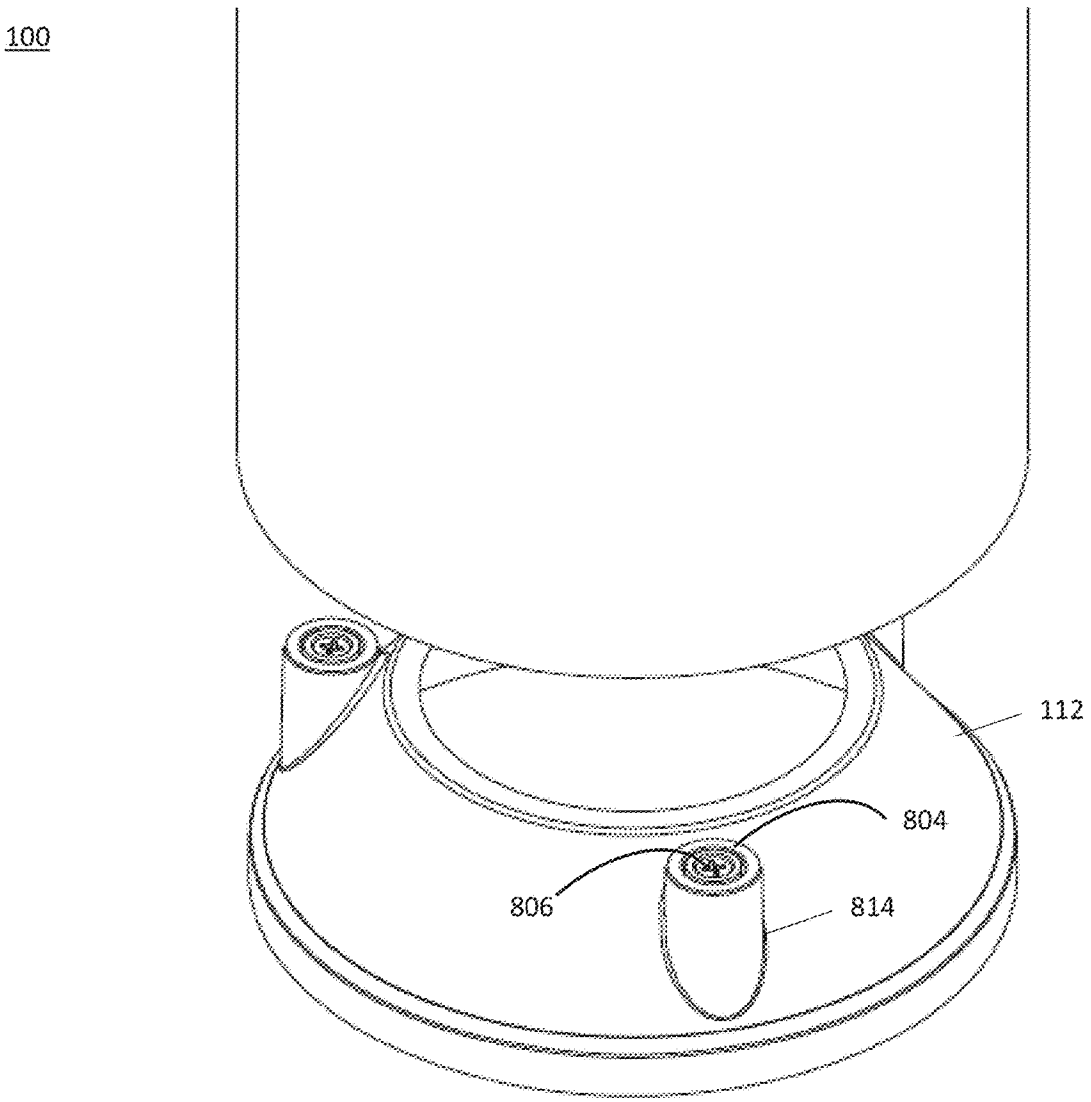
FIG. 8 is a perspective side view of a portion of the outer housing and a trim member of the example lighting device of FIG. 1.
Figure 9:
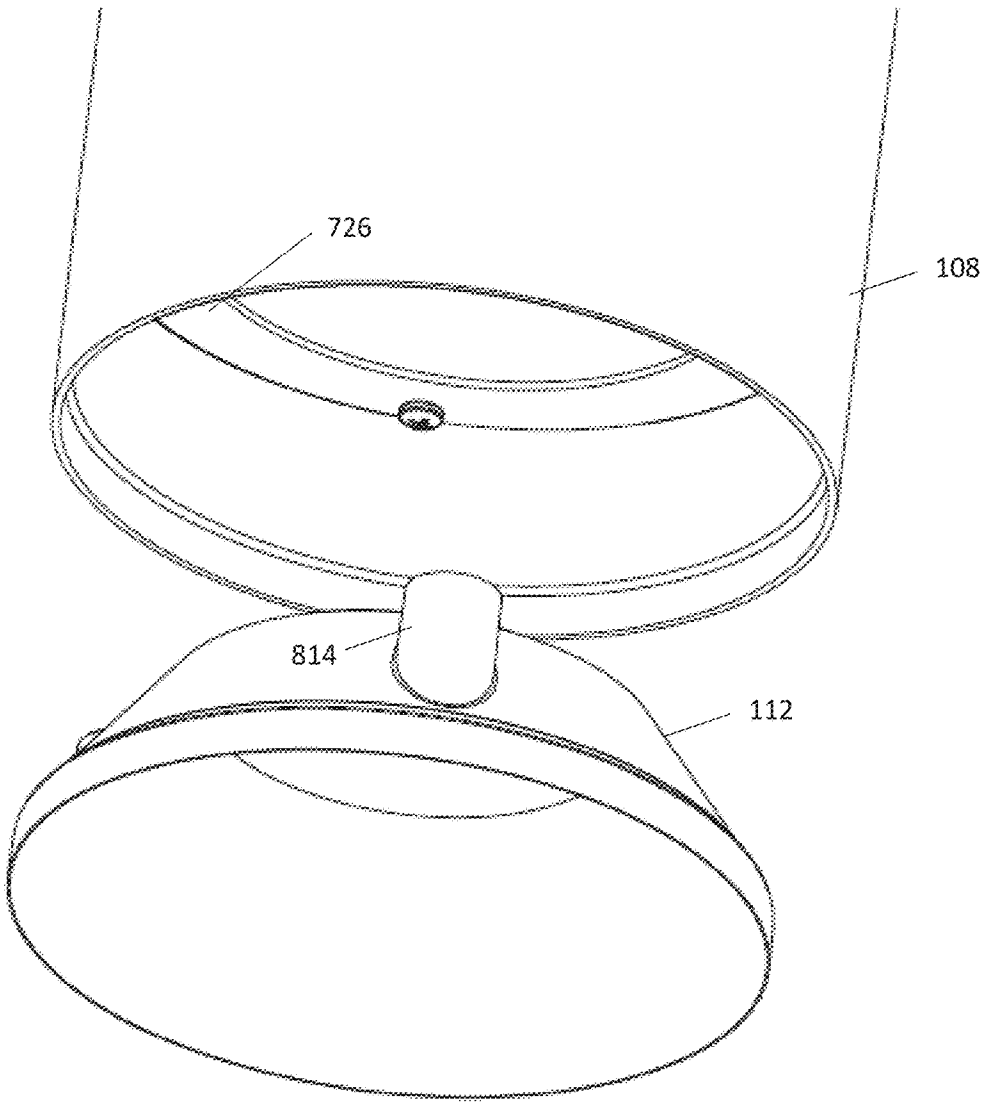
FIG. 9 is a perspective bottom view of a portion of the outer housing and a trim member of the example lighting device of FIG. 1.
Figure 10:
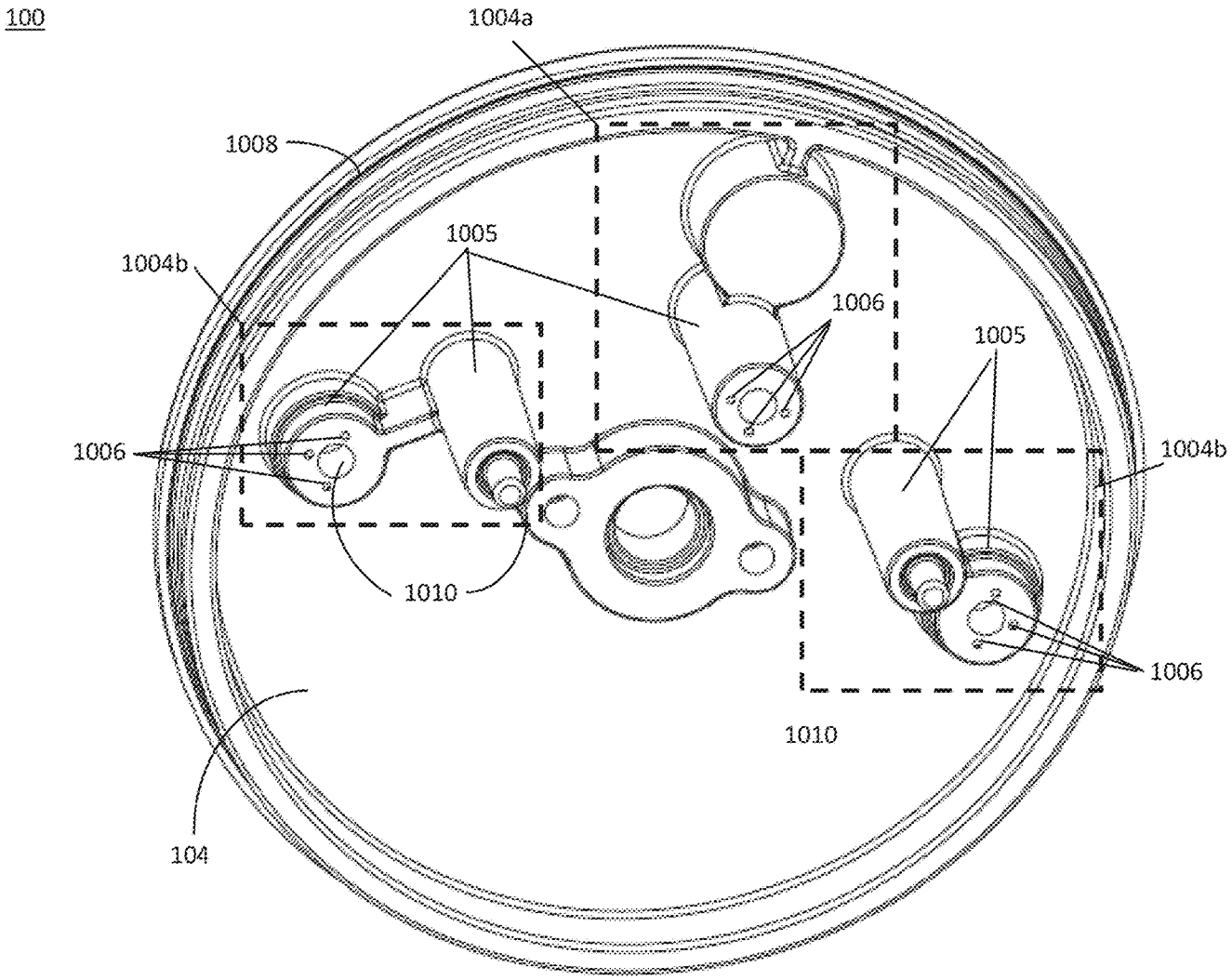
FIG. 10 is a perspective view of a cap of the lighting device of FIG. 1.

FIG. 1 is a perspective view of an example of a lighting device assembly 100, in a suspended or hanging orientation (for example, suspended from a ceiling or other structure, not shown). FIG. 2 is an exploded view of the lighting device assembly 100. FIG. 3 is a perspective, partially exploded bottom view of a portion of the lighting device assembly 100. FIG. 4 is a top view of a cap of the lighting device assembly 100. FIG. 5 is a perspective view of a portion of the outer housing assembly of the lighting device assembly 100, showing the rails on an inner sidewall of the outer house assembly. FIG. 6 is a perspective, partially exploded view of a portion of the outer housing assembly and a light engine heat sink of the lighting device assembly 100. FIG. 7 is a perspective, partially exploded view of a portion of the lighting device assembly 100. FIG. 8 is a perspective side view of a portion of the outer housing assembly and a trim member of the lighting device assembly 100. FIG. 9 is a perspective bottom view of a portion of the outer housing assembly and a trim member of the lighting device assembly 100. FIG. 10 is a perspective view of a cap of the lighting device assembly 100.

The lighting device assembly 100 includes various components such as a shaft 102, a cap 104, a driver housing and heat sink 106, an outer housing 108, a light engine housing and heat sink 110, and a trim member 112, as described below. While FIG. 1 shows one example of a lighting device shape and relative dimensions, other embodiments have other suitable shapes and relative dimensions.

To aid with the present description, FIG. 1 shows the outer housing 108 as partially transparent so that certain components within the outer housing 108 can be viewed in the drawings. While some lighting device assembly examples may include an outer housing 108 made of partially transparent materials (such as plastic, glass, ceramic, or the like), particular examples of the outer housing 108 are made with an opaque (not transparent), heat conductive material, such as, but not limited to metal, or other suitable materials including, but not limited to plastic, ceramic, composite material, combinations thereof, or the like.

The driver housing heat sink 106 may be configured to hold (e.g., contain or secure) a driver electronics module (e.g., driver electronics module 210 in FIG. 2). The light engine heat sink 110 may be configured to hold (e.g., contain or secure) an electronic chip and light source (e.g., circuit board 220 and light source 226 in FIG. 2). In other examples, one or more components of the lighting device assembly 100 may be omitted such as the shaft 102, the cap 104, and the trim member 112.

FIG. 2 is an exploded view of the example lighting device 100 of FIG. 1.

In the example in FIGS. 1 and 2, the outer housing 108 has a generally cylindrical shape (or a tubular structure), having a lengthwise dimension along a longitudinal axis A of the cylindrical shape, a round cross-section taken perpendicular to the axis A, and two open ends. In other examples, the outer housing 108 may have other suitable shapes including, but not limited to cylindrical with other cross-section shapes (such as, but not limited to oval, rectangular or other polygonal or combined cross section shape), spheroid, cuboid, or the like. Other outer housing 108 examples may include other suitable dimensions and shapes. The outer housing 108 may be made of any suitably rigid material or materials including, but not limited to metal, plastic, ceramic, composite material, or combinations thereof. The outer housing 108 houses the other components of the lighting device assembly 100 (including, for instance, the driver housing heat sink 106, the driver electronics module 210, the light engine heat sink 110, the light source 226, the optic member 222, and the lens 224). In some examples, the outer housing 108 provides part of an electrical grounding path that provides an electrical ground (e.g., facilitates a low resistance electrical ground pathway) for the light engine heat sink 110, the driver housing heat sink 106, the driver electronics module 210, and the cap 104.

The light engine heat sink 110, with the light source 226 secured thereto, is received in one open end (the bottom end in the orientation of FIGS. 1-3) of the outer housing 108. When the light source 226 is energized, the light source 226 emits light through an opening in the trim member 112. A cap 104 is provided over the opposite open end of the outer housing 108 (i.e., the top end in the orientation of FIGS. 1-3). The cap 104 may be covered by a cap cover 205, such as, but not limited to a decorative or ornamental cover, a label or the like. An example of the cap 104 is shown, without the cover 205, in FIG. 4.

Referring to FIG. 2, the interior of the outer housing 108 includes rails 206 extending parallel to the axial dimension A, from the cap end (top end in the orientation of FIG. 2) of the outer housing 108 at least to the location of the light engine heat sink 110. In some examples, an end of each of the rails 206 (the upper end in the orientation in FIGS. 1-3) is recessed from, and not flush with, the cap end (the upper end in the orientation in FIGS. 1-3) of the outer housing 108. In other examples, the ends of the rails 206 are flush with the cap end of the outer housing 108.

The rails 206 are attached (removably connected to, fixed to or formed integrally with) the interior of the outer housing 108. The rails 206 allow for certain components (e.g., the cap 104, the driver housing heat sink 106, the outer housing 108, and the light engine heat sink 110) of the lighting device assembly 100 to have a fixed orientation relative to each other, when assembled, and can simplify assembly.

In some configurations, in addition to the rails 206 fixing an orientation of components in the lighting device assembly 100, one or more portions of the outer housing may be shaped to mate with a shape or feature of the cap 104. For example, referring to FIG. 5, the inner diameter has a feature 530 that truncates the diameter of a portion of the outer housing 108. The inner diameter feature 530 provides an inner surface on a portion of the inner circumference of the housing 108, where the feature 530 has one or more different curvature radiuses relative to other portions of the inner circumference of the housing 108. In particular examples, the inner diameter feature 530 is provided or formed on the inner surface of the housing 108 and extends along a portion of the length of the outer housing 108, but not the entire length of the outer housing. In alternative examples, the inner diameter feature 530 may extend from the top end of the outer housing 108 to the bottom end of the outer housing. The inner diameter feature 530 may align one or more components in the outer housing 108. In particular examples, the inner diameter feature 530 aligns the one or more shaped protrusion features of the cap 104, when the cap is properly aligned on the outer housing 108. Accordingly, the inner dimeter feature 530 may prohibit the cap 104 from being installed incorrectly.

Referring back to FIG. 2, the rails 206 may position the components of the lighting device assembly 100 within the outer housing to facilitate dissipation of heat from the components of the lighting device assembly 100. In certain examples, the rails 206 may include apertures or slots that receive an end of one or more fasteners (e.g., screws, bolts, other threaded fasteners or non-threaded fasteners) extending through the cap mechanisms, to secure the cap 104 to the outer housing 108. In those or other examples, the cap end of the outer housing 108 or the rails 206 (or both) may be configured to receive a portion of the cap and include a connection mechanism such as, but not limited to a snap fit, a friction fit, a twist-lock connection, a threaded connection or other suitable connection between the cap and the outer housing 108 or the rails 206 (or both).

In some examples, the rails 206 may extend to a location recessed from the open end of the outer body 108 (the lower end in the orientation of FIGS. 1-3). In particular examples, the rails 206 extend to one end of the light engine heat sink 110 (the end facing upward in FIGS. 1-3). In those examples, the end of the light engine heat sink 110 may abut and connect to ends of the rails 206. For example, the ends of the rails 206 facing the light engine heat sink 110 may include one or more apertures or slots that receive an end of one or more fasteners (e.g., screws, bolts, other threaded fasteners or non-threaded fasteners) that extend through the light engine heat sink 110, to secure the light engine heat sink 110 to the rails 206 and to the outer housing 108. In other examples, the rails 206 may extend to or beyond the outward facing end (the bottom end in FIGS. 1-3) of the light engine heat sink 110.

The rails 206 may be configured to receive and guide the driver housing heat sink 106 in a sliding motion, from the open cap end of the outer housing 108 (before the cap 104 is secured), to a position in the interior of the outer housing 108. The rails 206 may be configured to receive and retain one or more flanges or tabs 207 extending laterally outward from to opposite sides of the driver housing heat sink 106. Alternatively, the rails 206 may be configured to be received within grooves extending longitudinally in the driver housing heat sink 106. The rails 206 may be made of any suitably rigid, electrically conductive material including, but not limited to metal.

Referring to FIG. 5, two rails **206*a* and 206*b* (corresponding to the rails 206 described herein) are provided on the inner surface of the outer housing 108. In particular examples, the rails 206 may be coupled to the interior of the outer housing 108 (e.g., casted, machined, integrated, molded, and the like). In other examples, the rails 206 may be removably coupled to the interior of the outer housing 108 (e.g., inserted into the interior of the outer housing 108**, secured using brackets, bolts, screws, rivets welds or other suitable fasteners).

Each rail **206*a*, 206*b* may include two opposing, spaced rail walls (e.g., 514*a*, 514*b* associated with rail 206*a*, and 524*a*, 524*b* associated with rail 206*b*). A channel is provided between the rail walls 514*a* and 514*b*, and another channel is provided between the rail walls 524*a* and 524*b*. Each of the one or more flanges or tabs 207 of the driver housing heat sink 106** is sized and shaped to fit within one of the channels provided between the rail walls, and allow the light engine heat sink to slide along the length dimension of the rail (and the channel).

In some examples, the light engine heat sink 110 may have similar flanges, tabs or grooves and may slidably connect with the rails 524*a* or 524*b* in a manner similar to that described with regard to the driver housing heat sink 106.

In further examples, each of the rails 206*a* and 206*b* may be formed of a single rail wall, or may be formed as recessed grooves formed along the length dimension of the inner wall of the outer housing 108. Some examples include two rails 206*a* and 206*b*, for example, arranged on opposite sides of the inner surface of the outer housing 108. Other examples may include a single rail 206*a*, or more than two rails 206*a* and 206*b* arranged around the inner surface of the outer housing 108. For example, as shown, multiple rails 206*c*, 206*d*, 206*e*, 206*f* receive extensions on the driver housing heat sink 106 (or other components of the lighting device assembly) for slidably connecting the driver housing heat sink 106 (or other components) to the outer housing 108. The multiple rails 206*a*-206*f* may restrict or prohibit the driver housing heat sink 106 from moving within the outer housing 108 and/or align the driver housing heat sink 106 in one or more particular orientations in the outer housing 108.

The light engine heat sink 110 may be composed of a body of generally rigid material having good thermal conductivity characteristics to efficiently conduct heat. In particular examples, the light engine heat sink 110 includes a single, unitary block or plate of aluminum, copper or other metal having significant or substantially great heat conduction capabilities. In certain examples, the light engine heat sink 110 may be formed (e.g., cast or forged) from solid aluminum. However, in other examples, the light engine heat sink 110 may be composed of other materials or of multiple parts that are fixed or connected together to form a heat sink structure as described herein.

In particular examples, the body of the light engine heat sink 110 has a generally cylindrical shape with fins (e.g., fins 616 in FIG. 6) for further heat dissipation. For instance, the fins may be heat radiation fins. In other examples, the light engine heat sink 110 body may have a cuboid, block, brick shape, circular, or other polygonal shape with or without fins. In other examples, the fins may be any structure configured to dissipate heat.

The light engine heat sink 110 includes a surface on which a light source 226 is mounted. The light source 226 is arranged to emit light outward from the surface, toward the trim 112. As described herein, the light source 226 and the optic member 222 are configured to emit light in a cone or other pattern having an axial direction or light emission direction.

FIG. 3 shows the light source 226 mounted in thermal communication with the downward facing surface of the light engine heat sink 110, such that the light engine heat sink 110 may efficiently receive and conduct heat from the light source 226. In certain examples, the surface of the light engine heat sink 110 may be in direct contact with the light source 226, to efficiently transfer heat away from the light source. In certain examples in which the light source includes a circuit board or other electronics on which one or more light emitting devices are mounted, the circuit board 220 may be mounted in direct contact with (e.g., generally flat or flush against the surface) the light engine heat sink 110 to enhance the ability to transfer heat from the circuit board 220 (or from components on the circuit board) to the light engine heat sink 110. In other examples, the circuit board 220 or other electronics may be housed inside the light engine heat sink 110. For example, the light engine heat sink may be hollow or partially hollow to contain the light source 226.

The light source 226 may include any suitable light emitting device or devices (not shown). In particular examples, the light source 226 includes one or more LEDs or other light sources that generate heat during operation. In such examples, the one or more LEDs (or other light sources) may be mounted on the circuit board 220 or other support structure. As described herein, the light engine heat sink 110 is configured to conduct and dissipate heat away from the light source 226, which can significantly improve the efficiency and light output of the one or more LEDs (or other heat-generating light sources). While particular examples described herein include a light source having one or more LEDs, other examples may include other suitable light sources such as, but not limited to one or more halogen, halide, fluorescent, or incandescent light sources, or other electrical discharge or electroluminescence device, or the like.

The light engine heat sink 110 may include one or more passages through which one or more electrical wires or other electrical conductors (not shown) extend. The electrical wires or other conductors connect to the light source 226 located on the light engine heat sink 110, and extend out of an opening in the light engine heat sink 110 to a suitable driver circuit, control electronics and/or power supply (e.g., the driver electronics module 210). In some examples, the body of the light engine heat sink 110 has one or more openings through which the electrical wires or other conductors extend, and a cover may be provided over the opening(s).

In various examples, the wires or other conductors may include or be configured to connect to a source of electrical power through a driver and/or other electronics (e.g., the driver electronics module 210) to convert power provided from a power source to a suitable power for driving the light source 226. In other examples, some or all of the electronics may be provided on the light source 226 (e.g., on a circuit board 220 of the light source 226), or in another electronic circuit contained in the interior of the outer housing 108. In yet other examples, some or all of the driver and electronics may not be contained external to the outer housing 108. The shaft 102 may be hollow and configured to hold one or more (or a plurality of) electrical conductors, to supply the power, ground connection, electric control information, or combinations thereof, to the lighting device assembly 100.

In particular examples, the light source 226 includes an LED, and the driver electronics module 210 includes one or more LED drivers to drive the LED light source 226. In some examples, the driver electronics module 210 (or other electronics within the outer housing 108) may include a processor to execute instructions stored on memory (e.g., non-transient computer readable media) to process data and/or to control various functions of the lighting device (e.g., temperature, light output, color of light, direction of light, focus of light, and/or the like).

In the example in FIG. 6, the light engine heat sink 110 may be removably coupled to rails 206 (e.g., rails 206*a* and 206*b* in FIG. 5) within the interior of the outer housing 108, by one or more (or a plurality of) fasteners (such as, but not limited to screws, bolts or other threaded fasteners or non-threaded fasteners, rivets, glue, other adhesives, solder, welds, clamps, friction or press fitted features, combinations thereof, or the like). The one or more fasteners (represented by threaded screws 606 in FIG. 6) are configured to connect the light engine heat sink 110 to the rails 206, and also to allow the light engine heat sink 110 to be selectively disconnected from the rails 206, from a connected state. The ability to selectively connect and disconnect the light engine heat sink 110 to the rails 206 (and to the outer housing 108) can improve the ability to access the light source 226 and the electronics associated with the light source 226 (e.g., on circuit board 220 in FIG. 2), for inspection, servicing, replacement, and the like.

In particular examples, when the light engine heat sink 110 is received in an open end of the outer housing 108 (the bottom end in the orientation of FIG. 6), rail engaging features on the light engine heat sink 110 align with and engage the rails 206 in the interior of the outer housing 108. The rail engagement features may include one or more flanges, tabs or grooves, as described with regard to the driver housing heat sink 106. In the example in FIG. 6, the light engine heat sink 110 includes two grooves 612 that align with and receive a portion the rails 206 when the light engine heat sink 110 is received in the outer housing 108.

When the rails 206 are received in the grooves 612, the light engine heat sink 110 may be secured to the rails 206 (and to the outer housing 108) by fasteners 606. When connected to the rails 206, the light engine heat sink 110 is in sufficiently close proximity or contact with the inner surface of the outer housing 108, to communicate and dissipate heat from the light engine heat sink 110 to the rails 206 and to the inner surface of the outer housing 108. In addition, when the light engine heat sink 110 is connected to the rails 206, the fins 616 of the light engine heat sink are located within the interior of the outer housing 108, to dissipate heat to the inner surface of the outer housing 108. As discussed above, the outer housing 108 may be made of a heat conducting and dissipating material to effectively dissipate heat received from the light engine heat sink 110, into the external environment around the outer housing 108.

In particular examples, the pattern of the fins 616 on the light engine heat sink 110 or the rail engagement features (or both the fins and the rail engagement features) are arranged to align with the rails 206 in only one orientation (or in only two or other limited number of orientations) of the light engine heat sink 110 relative to the outer housing 108. In some examples, the rails 206 facilitate the alignment of the light engine heat sink 110 such that the fasteners 606 may be threaded into the rails 206, through the channels 612, when the light engine heat sink 110 is received in the outer housing 108, in the one orientation (or one of the limited number of orientations). The ease of alignment can make assembly and installation of the lighting device assembly more efficient and consistent.

A shaped surface or head of the fasteners 606 may have a slot-shaped recess (for engagement by a flat-head screwdriver), a cross or star-shaped recess (for engagement by a Philips screwdriver), a hexagonal or other polygonal shaped recess (for engagement by an Allen wrench, star wrench or other tool), or hexagonal or other polygonal shaped head (for engagement by a socket wrench, crescent wrench or other tool), a wheel shape (for gripping by a user's finger and thumb), or other suitable shapes for engagement and rotation by a tool or a user's hand.

In certain examples, the light engine heat sink 110 includes one or more (or a plurality of seal members) to provide a seal between the outer housing 108 and the body of the light engine heat sink 110, when the light engine heat sink 110 is received and installed in the outer housing 108. For example, the light engine heat sink 110 or the inner surface of the outer housing 108 (or both) may include one or more annular grooves (e.g., grooves 614 in the light engine heat sink 110 in FIG. 6) to hold one or more seal members such as, but not limited to o-rings, gaskets, curable or dryable sealing material, or the like, arranged between the light engine heat sink 110 and the outer housing 108. In particular examples, the seal is configured to inhibit passage of water (e.g., a water-tight seal), moisture, or other environmental materials.

In particular examples, the head of the fasteners 606 associated with each of the rails 206 is provided at a location on the light engine heat sink 110 that is visible or accessible (or both) through the open end of the lighting device assembly 100 when the trim member (not shown) is not connected to (removed from) the lighting device assembly 100. In other examples, the head of the fasteners 606 in each of the rails 206 is provided at a location on the light engine heat sink 110 that is visible or accessible (or both) through the open end of the lighting device assembly while the trim member (not shown) is connected to the lighting device assembly.

In the example in FIG. 7, the trim member 112 may be installed on the lighting device assembly 100. In particular examples, the trim member 112 may include an annular body that has a tapered inner surface forming a smaller opening facing the optic member 222, and a larger opening facing in the direction of the outward facing side of the lighting device assembly (facing downward in the orientation of FIG. 7). In the example in FIG. 7, the trim member 112 has an annular body in the shape of a partial cone. In other examples, the trim member 112 may have other suitable annular shapes including, but not limited to cuboid, block, brick shape, circular, or other polygonal shapes.

The optic member 222 is secured to an end (the lower end in FIG. 7) of the light engine heat sink 110, and is configured to direct light from the light source (not shown) on the light engine heat sink 110, through a cover or lens 224. The cover or lens 224 is secured to the light engine heat sink 110 and may include a seal 705 (such as, but not limited to an O-ring, gasket, or the like) to seal the cover or lens 224 to the light engine heat sink 110 and inhibit passage of water, moisture or other environmental materials. The cover or lens 224 may be secured to the light engine heat sink 110 by any suitable securing mechanism or fasteners. In the example in FIG. 7, a ring-shaped member 726 is arranged partially overlapping the outer peripheral edge of the cover or lens 224 (with the cover or lens 224 arranged between the ring-shaped frame member 726 and the end of the light engine heat sink 110). In addition, the frame member 726 is attached to the light engine heat sink 110 by one or more fasteners 728, to secure the cover or lens 224 and the seal 705 to the light engine heat sink 110. In other examples, the cover or lens 224, frame member 726, and seal 705 may be omitted.

The trim member 112 is arranged to allow light from the light exit side of the optic member 222 to exit the lighting device assembly. The trim member 112 may be made of any suitably rigid material such as, but not limited to, metal, plastic, ceramic, composite material, or combinations thereof. In some examples, the inner surface of the trim member 112 is reflective or has a coating or treatment to enhance reflection of light. In those or other examples, the trim member 112 may have an ornamental or decorative shape, color, coating, combination thereof, or the like.

The trim member 112 may be removably coupled (e.g., fastened, clamped, magnetically coupled, fitted, and the like) to the light engine heat sink 110. In particular examples, one or more portions of the light engine heat sink 110 may be magnetized. In some examples, the frame member 726 may be made of a magnetically attractable material such as, but not limited to steel. In other examples, a magnetically attractable material (such as, but not limited to a steel ring) may be embedded in the downward facing surface of the light engine heat sink 110.

As shown in FIGS. 8 and 9, one or more portions of the trim member 112 may include one or more magnets or be magnetized. In particular examples, fastener 806 (such as a screw) may secure annular, disk-shaped magnets 804 (e.g., washer like structures) to the trim member 112 via risers 814 (or pillars). The risers 814 may be made of the same material or different material as the trim member 112. In particular examples, the risers 814 are connected to the trim member 112 (e.g., molded, machined, forged). In other examples, the risers 814 may be removably connected to the trim member 112 (e.g., via adhesive, clamps, screws, bolts, and the like). The risers 814 may include threaded openings or other connection mechanisms that facilitate a connection of the magnets 804 to the trim member 112, using fasteners 806 for instance. The magnets 804 may be other shapes and fastened to the trim member 112 in other ways. In other examples, the trim 112 may be magnetized in other ways.

In particular examples, each riser 814 supports the connection of one respective magnet 804 to the trim member 112. One or more magnets 804 may be used to magnetically secure the trim member 112 to the light engine heat sink 110. In the example in FIG. 8, three magnets 804 are arranged at equal spacing around the annular body of the trim member 112. Other examples may include other suitable numbers or shapes of magnets on the trim member 112. FIG. 9 shows the risers 814 on the trim member 112 being magnetically connected to (or selectively connected to) the ring-shaped frame 726 in the outer housing 108.

In alternate examples, the magnetized components of the trim member 112 and the light engine heat sink 110 may be reversed. For example, the trim member 112 may include one or more magnetically attractable materials (such as, but not limited to the steel ring-shaped member 726), and the light engine heat sink 110 may include one or more magnets arranged to engage the magnetically attractable material on the trim member. The magnetized coupling of the trim member 112 to the light engine heat sink 110 can improve manufacturing efficiency as the same lighting device assembly may be manufactured for multiple different types or styles of trim members. Further, the magnetized coupling of the trim member 112 allows for a simplified assembly or replacement of the trim, as well as easy removal (or temporary removal) of a trim member 112 to access the light source, optic member, and/or the light engine heat sink 110.

In particular examples, the optic member (e.g., 222 in FIG. 2) is configured to focus and direct light in a manner to pass most of the light emitted from the light source (connected to the light engine heat sink 110) through an opening in the trim member 112. The optic member has a light entry side (e.g., the side facing upward toward the light source 226) and a light exit side (the side facing downward toward the trim member 112). The optic member may be made of any suitably transparent or partially transparent material such as, but not limited to, plastic, glass, ceramic, or combinations thereof. In some embodiments, the optic member may be held by and secured to the light engine heat sink 110 by an optic holder (not shown).

Referring back to FIG. 2, the driver housing heat sink 106 may be composed of a body of generally rigid material having good thermal conductivity characteristics to efficiently conduct heat. In certain examples, the driver housing heat sink 106 may be hollow or partially hollow to define an interior volume in which the driver electronic module 210 is contained (held, housed, or secured).

In particular examples, the body of the driver housing heat sink 106 has a generally cylindrical shape with fins for further heat dissipation. In other examples, the driver housing heat sink 106 body may have a cuboid, block, brick shape, circular, or other polygonal shape with or without fins. In other examples, the fins may be any structure configured to dissipate heat.

The driver housing heat sink 106 may be removably coupled to rails 206 positioned on the interior of the outer housing 108. For example, the driver housing heat sink 106 may be inserted at an opening of the outer housing 108 and engaged with the rails 206. The rails 206 may be configured to engage the driver housing heat sink 106 and the outer housing 108.

In some examples, the pattern of the fins 616 on the light engine heat sink 110 or the rail engagement features (or both the fins and the rail engagement features) are arranged to align with the rails 206 in only one orientation (or in only two or other limited number of orientations) of the driver housing heat sink 106 relative to the outer housing 108, when the light engine heat sink 110 is received in an open end (the upper end in FIG. 2) of the outer housing 108. In some examples, the rails 206 facilitate the alignment of the driver housing heat sink 106 and the rails 206 when the light engine heat sink 110 is received in the outer housing 108 in the one orientation (or one of the limited number of orientations). The ease of alignment can make assembly and installation of the lighting device assembly more efficient and consistent.

In some examples, there may be one or more plugs to limit the movement of the driver housing heat sink 106 in the outer housing 108 on the rails 206. The plugs may form stop surfaces that abut and stop the movement of driver housing heat sink 106 on the rails 206 at desired positions along the length dimension of the rails. The plugs may be removably coupled to the rails 206 (e.g., fastened to the rails, adhered to the rails, magnetically attracted to the rails, and the like). The position of the plugs on the rails of the outer housing 108 may be adjustable (e.g., removing the plugs and repositioning the plugs on the rails, motorizing the plugs, sliding the plugs). In other examples, the plugs may be permanently coupled to the rails (e.g., machined, casted, formed, forged, manufactured).

The driver housing heat sink 106 may include one or more passages through which one or more electrical wires or other electrical conductors extend. The electrical wires may supply the power, ground connection, electric control information, or combinations thereof. The electrical wires or other conductors extend out of one or more openings in the driver housing heat sink 106 and electrically connect the driver electronics module 210 and the light source 226 (or electronics associated with the light source like circuit board 220) located on the light engine heat sink 110. A cover may be provided over the opening(s). The driver electronics module 210 may supply power and other control information to the light source 226.

In some embodiments, the driver housing heat sink 106 may be removably coupled (e.g., mounted, screwed, bolted) to cap 104. The cap 104 may be made of any suitably rigid and electrically conductive material such as, but not limited to metal. In particular examples, the cap 104 may be removably connected to the outer housing 108 with any suitable connection mechanism. For example, groove 1008

(in FIG. 10) on the cap 104 may act as a threaded fastener for securing the outer housing 108 to the cap 104. The grooves 1008 on the cap 104 may be received by a threaded opening in the outer housing 108. The cap 104 may be configured to secure over an open end (the upper end in FIG. 2) of the outer housing 108, or may be configured to fit within or partially within that open end to secure to the outer housing 108.

As shown in FIG. 10, the cap 104 may be configured with one or more protrusions 1004 (protrusion 1004*a* and protrusion 1004*b* are collectively called protrusions 1004), where one or more protrusions may have a channel 1005 extending through the cap 104. Each protrusion 1004 may include multiple parts. A first part of the protrusion may be a first length. The first part of the protrusion may be configured to connect to a first portion of the lighting device assembly 100 (e.g., the driver housing heat sink 106). A second part of the protrusion may be a second length. The second part of the protrusion may be configured to connect to a second portion of the lighting device assembly 100 (e.g., the rails 206). In some configurations, the first length is a length different from the second length. Additionally or alternatively, the first length may be the same length as the second length.

The channels 1005 in the protrusions 1004 may be configured to receive fasteners 1010 (such as, but not limited to screws, bolts or other threaded fasteners or non-threaded fasteners) for securing the cap 104 to the rails 206 of the outer housing 108 (and to the driver housing heat sink 106). In some configurations, the fasteners are self-tapping screws. The fasteners may be configured to be received by a portion of the lighting device assembly 100 such that the screw forms threads by being pressed into the surface of the portion of the lighting device (e.g., the driver housing heat sink 106 and/or the rails 206). Additionally or alternatively, the fastener may be a threaded fastener, and the threaded fastener configured to be received in a threaded bore. Various further examples may include any suitable connection mechanism for connecting the cap 104 to the outer housing 108, including, but not limited to a clip or snap connection, a bayonet locking connection, a threaded connection, or other twist-locking mechanism.

Figure 11:
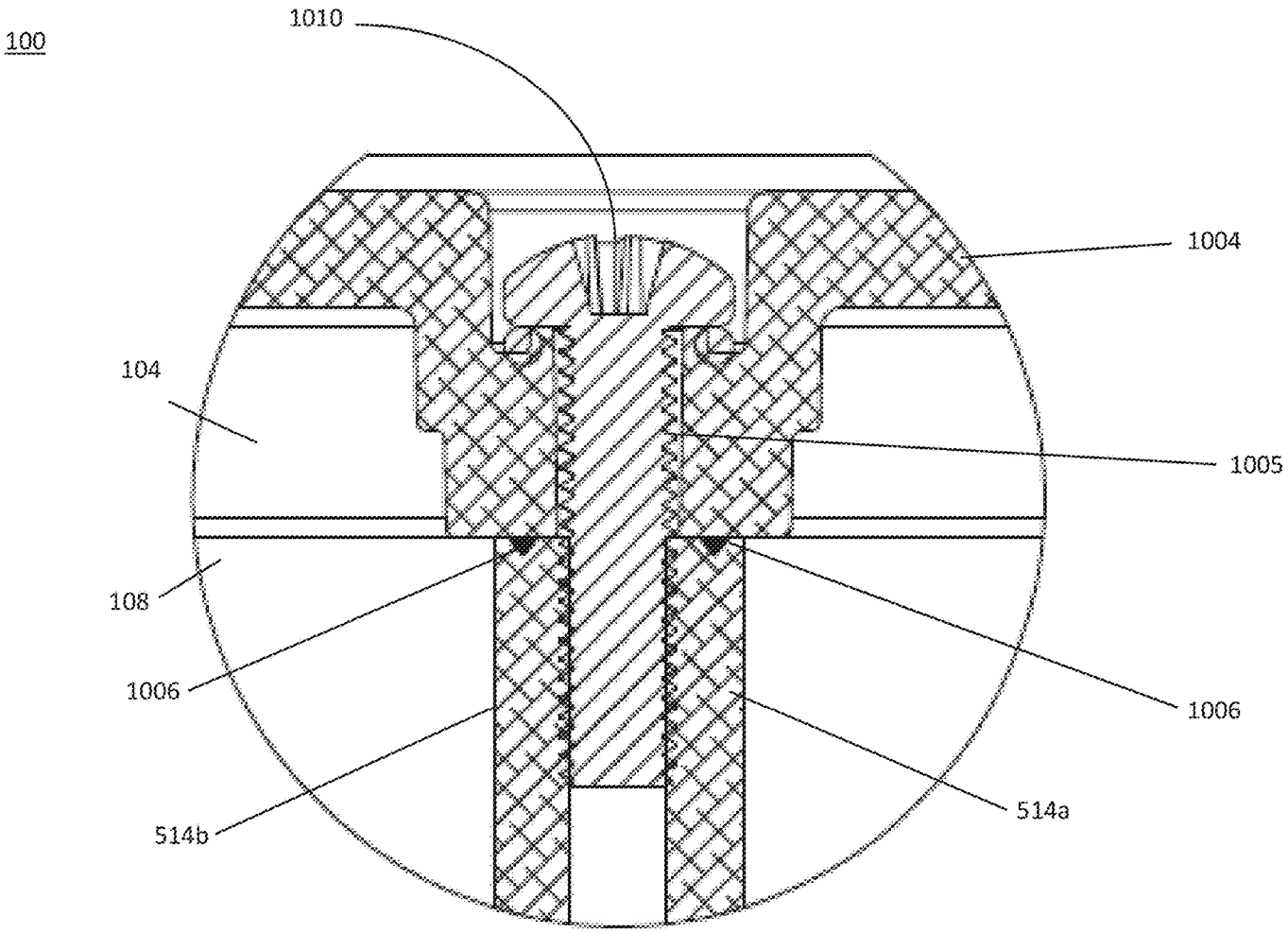
FIG. 11 is a perspective view of a cap of the lighting device of FIG. 1.

Each protrusion 1004 (and/or part of the protrusion) may be configured to connect to the same or different portions (or components) of the lighting device assembly 100. The channels 1005 in the protrusions 1004 may be configured to align with (or be received by) various components in the lighting device assembly 100. For example, a channel 1005 of protrusion 1004*a* may align with a channel in the driver housing heat sink 106, such that fasteners may extend through the channels 1005 in the protrusions 1004*a*, to connect the cap 104 and the driver housing heat sink 106 together. Similarly, the channels 1005 in the protrusions 1004*b* may align with channels in the rails 206 (or other portions of the outer housing 108), such that fasteners may extend through the channels 1005 to secure the cap 104 (together, as a unit with the driver housing heat sink 106), to the rails 206 (and to the outer housing 108). FIG. 11 shows a fastener 1010 inserted into a threaded channel 1005 of protrusion 1004*b*. A channel is formed for the fastener 1010 via rail walls 514*a* and 514*b* (from rail 206*a* in FIG. 5), connecting the cap 104 to the outer housing 108.

In particular examples, the cap 104 may support (or suspend) the driver housing heat sink 106 as the cap 104 is secured to the outer housing 108, such that the driver housing heat sink 106 is suspended within the interior of the outer housing 108, as the cap 104 is secured to the outer housing 108. The suspended driver housing heat sink member 106 may be oriented and/or positioned in a desired orientation and position via rails in the outer housing.

One or more surfaces of one or more (or each) of the protrusions 1004 may include one or more sharp edges or spikes 1006. The spikes 1006 may be wedge or prism shape (having a triangular cross-section shape) where the wider end of the triangle cross-section shape is closer to the surface entry of the channel 1004 than the narrow end of the triangle cross-section shape. In some examples, the fasteners 1010 that extend in the channels 1005 of the protrusions 1004 may be configured with spikes. In other examples, the components of the lighting device that interface with the channel 1004 may be configured with spikes.

The spikes 1006 may be formed of the material of the protrusions 1004 and cap 104, or of any rigid and electrically conductive material such as, but not limited to metal. The spikes 1006 may be removably coupled to the surface of the protrusions 1004 (using fasteners, bolts, clamps, adhesive) or may be formed integral or permanently coupled to the surface of the protrusions 1004. The number of spikes 1006 on the surface of each protrusions 1004 may be the same and/or different as between different protrusions 1004. In the illustrated example, there are 3 spikes 1006 on each protrusion 1004 having spikes. In other examples, one, two or more than 3 spikes may be provided on each protrusion 1004 or selected protrusions 1004.

When the protrusions 1004 becomes engaged with the components of the lighting device (e.g. the rails 206 and the driver housing heat sink 106), the spikes 1006 become engaged with the metal structures of those components of the lighting device. The spikes 1006 may scratch through any coating or paint on the components and become at least partially embedded in those components of the lighting device. The embedded spikes 1006 in the components of the lighting device create an electrical connection (or an improved low resistance electrical pathway) between the components of the lighting assembly and cap 104. FIG. 11 shows spikes 1006 in the protrusion 1004 being embedded into each of the rail walls 514*a* and 514*b*.

As discussed herein, the driver electronics module (e.g., 210 in FIG. 2) includes wires for power, control, and ground. At least one ground wire connected to one or more circuit boards (or chips) on the driver electronics module may also be electrically coupled to ground (or be grounded by) the body of the driver housing heat sink 106. When the spikes 1006 of protrusion 1004*a* become engaged and electrically connected to the driver housing heat sink 106, the cap 104 on which the spikes are provided becomes electrically connected (and grounded) to the driver housing. In operation, the driver housing heat sink 106 grounds the cap 104.

The cap 104 is configured to be electrically connected with the outer housing (e.g., outer housing 108 in FIG. 2), when the cap 104 is connected to the outer housing 108 via protrusions 1004*b*. In addition, the cap 104 is configured to be electrically connected for ground to the driver housing heat sink 106 via spikes 1006 in protrusion 1004*b* (as discussed above). The light engine heat sink, light source, and trim may also be electrically connected to ground by their physical connection to the outer housing (e.g., via the rails of the outer housing).

Accordingly, when the driver housing heat sink 106 is connected to the cap 104, and the cap 104 is connected to the outer housing 108, a common ground connection is provided between the driver housing heat sink 106 (and the ground wire connection thereto), and other components of the lighting device assembly including the cap 104, the outer housing 108, light engine heat sink 110, light source and trim 112. Accordingly, additional grounding wires to the cap, the outer housing, the light source heat sink and the trim are not necessary.

Referring back to FIG. 2, the shaft 102 is configured to support (contain, house, secure) electrical conductors that provide power (or other electronic information such as control signals) to the lighting device assembly 100. In particular examples, the shaft 102 suspends the lighting device assembly 100 from a ceiling, wall, or other object. In other examples, the shaft 102 may be omitted and the lighting device assembly 100 may be configured to be mounted in an enclosed environment, such as, but not limited to, a recess of a ceiling, wall or other object. In these examples, the shaft 102 may not be visible (and/or may be omitted). In yet other examples, the lighting device assembly 100 may be configured to be surface mounted on a surface of a ceiling, wall or other object, or mounted on a pedestal or other support structure extending from a ceiling, wall, or other object.

The shaft 102 may be rigid or flexible, and made of any suitably rigid or flexible material or materials including, but not limited to metal, plastic, ceramic, composite material, or combinations thereof. The shaft may be hollow, solid, and/or house one or more electrical cables for use in the lighting device assembly 100.

In various examples described herein, certain components are described as having a cone shape, cylindrical shape, and a triangular-shape including, but not limited to the outer housing 108, the driver housing heat sink 106, the light engine heat sink 110, the cap 104, the trim 122 and the spikes on cap 104. However, in other examples, those components may have other suitable shapes including, but not limited to shapes having polygonal or other circular or non-circular cross-sections or combinations thereof. In some examples, those components may have an outer shape configured to provide an aesthetically pleasing, artistic, industrial or other impression.

The foregoing description of illustrative embodiments has been presented for purposes of illustration and of description. It is not intended to be exhaustive or limiting, and modifications and variations may be possible in light of the above teachings or may be acquired from practice of the disclosed embodiments. Various modifications and changes that come within the meaning and range of equivalency of the claims are intended to be within the scope of the invention. Thus, while certain embodiments of the present invention have been illustrated and described, it is understood by those of ordinary skill in the art that certain modifications and changes can be made to the described embodiments without departing from the spirit and scope of the present invention as defined by the following claims, and equivalents thereof.

What is claimed is:

1. A lighting device assembly comprising:

an outer housing having an inner volume, at least one inner surface at least partially surrounding the inner volume, a first open end and a second open end;

at least one rail on the at least one inner surface of the outer housing;

a first heat sink member configured to be received at least partially within the first open end of the outer housing and be secured to the at least one rail;

a light source attached to the first heat sink member;

a cap that attaches to the outer housing to cover the second open end of the outer housing;

a second heat sink member holding one or more driver electronics modules that connect to the light source, the second heat sink member being secured to the cap and configured to be received at least partially within the second open end of the outer housing when the cap attaches to the outer housing; and one or more electrical wires, each extending from the one or more driver electronics modules and electrically connecting the light source and the driver electronics module together.

2. The assembly of claim 1, wherein the first and second heat sink members are configured to dissipate heat into the inner volume of the outer housing when the first and second heat sink members are received at least partially within the outer housing, and wherein the outer housing is configured to dissipate heat from the inner volume to an environment external to the outer housing.

3. The assembly of claim 1, wherein each of the first and second heat sink members are made of a thermally conductive material and have one or more heat radiation fins for dissipating heat from the first and second heat sink members into the inner volume of the outer housing when the first and second heat sink members are received at least partially within the outer housing, and wherein the outer housing is made of a thermally conductive material that is configured to dissipate heat from the inner volume.

4. The assembly of claim 1, wherein the outer housing comprises a tubular structure and the at least one rail comprises two or more rails on the at least one inner surface.

5. The assembly of claim 1, wherein the light source is attached to the first heat sink member in a position to emit light from the first open end of the outer housing when the first heat sink member is received at least partially within the first open end of the outer housing.

6. The assembly of claim 1, further comprising a trim member configured to selectively connect to and disconnect from the lighting device assembly, at a location adjacent the first open end of the outer housing.

7. The assembly of claim 1, further comprising:

a trim member configured to selectively connect to and disconnect from the lighting device assembly, at a location adjacent the first open end of the outer housing; and an annular frame member of magnetically attractable material attached to the first heat sink member, the annual frame member having a central opening arranged relative to the light source to pass light from the light source through the central opening;

wherein the trim member includes one or more magnets that is magnetically connected to the annular frame member.

8. The assembly of claim 7, wherein the trim member includes one or more risers securing the one or more magnets to the trim member.

9. The assembly of claim 1, wherein each rail has a first end to which the first heat sink member connects when the first heat sink member is received at least partially within the first open end of the outer housing, and wherein each rail has a second end to which the cap connects, to attach the cap over the second open end of the outer housing.

10. The assembly of claim 1, wherein the cap has one or more protrusions, each protrusion having a channel for receiving a fastener for fastening the cap to the outer housing.

11. The assembly of claim 10, wherein the one or more protrusions include one or more spikes on a surface facing the at least one rail, for at least partially embedding into the at least one rail when the cap is fastened to the outer housing, to provide or enhance an electrical ground coupling of the cap with the outer housing.

12. A lighting device assembly comprising:

an outer housing having an inner volume, at least one inner surface at least partially surrounding the inner volume, a first open end and a second open end;

at least one rail on the at least one inner surface of the outer housing;

a first heat sink member configured to be received at least partially within the first open end of the outer housing and be secured to the at least one rail;

a light source attached to the first heat sink member; and a cap that attaches to the outer housing to cover the second open end of the outer housing; a second heat sink member holding one or more driver electronics modules that connect to the light source, the second heat sink member being secured to the cap and configured to be received at least partially within the second open end of the outer housing when the cap attaches to the outer housing;

wherein the cap has one or more protrusions having one or more spikes on a surface facing the second heat sink member, for at least partially embedding into the second heat sink member, to provide or enhance an electrical ground coupling of the cap with the second heat sink member.

13. The assembly of claim 1, further comprising at least one ground wire connected to the second heat sink member and configured for connection to an external ground, wherein the second heat sink member is in electrical communication with the cap, and wherein the cap is in electrical communication with the outer housing when the cap is attached to the outer housing, to connect the external ground to the cap and to the outer housing.

14. The assembly of claim 1, wherein the first heat sink member has an exterior surface with one or more grooves, and wherein a fluid seal is received in the one or more grooves for providing a water-tight seal between the first heat sink member and the outer housing when the first heat sink member is at least partially received within the first open end of the outer housing.

15. The assembly of claim 1, wherein the at least one light source comprises at least one LED.

16. The assembly of claim 1, further comprising a shaft to which the outer housing is connected, the shaft configured to be secured to a ceiling or other structure, to suspend the outer housing from the ceiling or other structure.

17. The assembly of claim 12, wherein the one or more spikes are integral with or permanently fixed to the one or more protrusions.

18. The assembly of claim 12, wherein the one or more spikes are wedge or prism shaped.

19. A method of making a lighting device assembly comprising:

providing an outer housing having an inner volume, at least one inner surface at least partially surrounding the inner volume, a first open end and a second open end;

providing at least one rail on the at least one inner surface of the outer housing;

attaching a light source to a first heat sink member;

receiving the first heat sink member with the light source at least partially within the first open end of the outer housing;

securing the first heat sink member to the at least one rail;

holding, in a second heat sink member, one or more driver electronics modules that connect to the light source;

securing the second heat sink member to the cap;

extending one or more electrical wires from the one or more driver electronics modules to electrically connect the light source and the driver electronics module together;

attaching the cap with the second heat sink member to the outer housing, to cover the second open end of the outer housing; and receiving the second heat sink member at least partially within the second open end of the outer housing when attaching the cap to the outer housing.

20. The method of claim 19, wherein the first and second heat sink members are configured to dissipate heat into the inner volume of the outer housing when the first and second heat sink members are received at least partially within the outer housing, and wherein the outer housing is configured to dissipate heat from the inner volume to an environment external to the outer housing.

21. The method of claim 19, further comprising:

providing the cap having one or more protrusions, each protrusion having a channel for receiving a fastener for fastening the cap to the outer housing;

providing the one or more protrusions with one or more spikes on a surface facing the at least one rail;

at least partially embedding the one or more protrusions into the at least one rail when the cap is fastened to the outer housing, to provide or enhance an electrical ground coupling of the cap with the outer housing.

22. The method of claim 19, further comprising connecting a selectively connectable trim member to the lighting device assembly adjacent the first open end of the outer housing, the selectively connectable trim member configured to selectively disconnect from the lighting device assembly.

* * * * *